US009306348B2

(12) United States Patent
Feng

(10) Patent No.: US 9,306,348 B2
(45) Date of Patent: Apr. 5, 2016

(54) LAMP CONNECTOR

(71) Applicant: HONG RU CONNECTORS CO., LTD., Guangdong Province (CN)

(72) Inventor: Zhu Feng, Guangdong Province (CN)

(73) Assignee: Hong Ru Connectors Co., Ltd., Dongguan (CN)

( * ) Notice: Subject to any disclaimer, the term of this patent is extended or adjusted under 35 U.S.C. 154(b) by 0 days.

(21) Appl. No.: 14/623,726

(22) Filed: Feb. 17, 2015

(65) Prior Publication Data

US 2015/0325966 A1 Nov. 12, 2015

(30) Foreign Application Priority Data

May 8, 2014 (CN) ..... 2014 2 0235394

(51) Int. Cl.

| | |
|---|---|
| ***H01R 13/28*** | (2006.01) |
| ***H01R 13/26*** | (2006.01) |
| ***H01R 24/70*** | (2011.01) |
| ***H01R 24/68*** | (2011.01) |
| ***H01R 24/78*** | (2011.01) |

(52) U.S. Cl.

CPC ..... *H01R 24/70* (2013.01); *H01R 24/68* (2013.01); *H01R 24/78* (2013.01)

(58) Field of Classification Search

CPC ..... H01R 24/70; H01R 24/78; H01R 13/26; H01R 13/28; H01R 24/514; H01R 13/27; H01R 13/4223; H01R 13/4233; H01R 24/68; H01R 9/2458

USPC ..... 439/700, 295, 405, 708, 558, 699.2, 439/170, 171, 172, 679, 744, 728, 852

See application file for complete search history.

(56) References Cited

U.S. PATENT DOCUMENTS

| | | | | |
|---|---|---|---|---|
| 2,838,739 | A * | 6/1958 | Winkler | H01R 13/26 439/295 |
| 3,091,746 | A * | 5/1963 | Winkler | H01R 13/26 439/295 |
| 3,654,586 | A * | 4/1972 | Winkler | H01R 13/64 439/295 |
| 4,335,931 | A * | 6/1982 | Kinnear | H01R 13/28 439/295 |
| 6,183,303 | B1 * | 2/2001 | Sato | H01R 9/053 439/585 |
| 7,374,460 | B1 * | 5/2008 | Hariharesan | H01R 13/187 439/679 |
| 7,628,630 | B2 * | 12/2009 | Chang | H01R 13/426 439/295 |
| 8,764,481 | B2 * | 7/2014 | Matsumoto | H01R 13/14 439/595 |
| 2014/0045387 | A1 * | 2/2014 | Furuya | H01R 13/428 439/746 |

* cited by examiner

*Primary Examiner* — Abdullah Riyami
*Assistant Examiner* — Harshad Patel
(74) *Attorney, Agent, or Firm* — Rosenberg, Klein & Lee

(57) ABSTRACT

A lamp connector comprises a contact and a connector body having an accommodation space accommodating the contact. The contact has a positioning hole. The connector body has a slot extending along an insertion direction of the contact and confining the contact thereinside. The accommodation space has a elastic member with a barb that corresponds to the positioning hole and has a guide slope. The contact can easily overcome elastic force of the elastic member, overpass the guide slope to go into the accommodation space and is longitudinally confined to the slot. Then, elastic force springs the barb into the positioning hole. Thus, the contact is transversely positioned in the plastic body. Thereby, the contact can be assembled to the plastic body faster, more conveniently and more firmly; the electric connection of the male plug and the female socket is more stable and more resistant to electromagnetic interference.

5 Claims, 4 Drawing Sheets

LAMP CONNECTOR

BACKGROUND OF THE INVENTION

This application claims priority for China patent application no. 201420235394.4 filed on May 8, 2014, the content of which is incorporated by reference in its entirely.

FIELD OF THE INVENTION

The present invention relates to a connector technology, particularly to a lamp connector.

DESCRIPTION OF THE RELATED ART

At present, the conventional lamp connector normally includes a male connector and a female connector, each of which is formed of a plastic body, and a positive contact and a negative contact inside the plastic body. The engagement of the contact and the body is realized by a barb structure. Such an engagement mechanism needs a more complicated structural design and a more troublesome assembly process but has a poorer engagement effect. Besides, the engagement of the male connector and the female connector of the conventional lamp connector merely relies on the elastic force of the front portions of the contacts and is more likely to loosen. Especially, the conventional lamp connector is likely to suffer poor contact after long-term usage. Therefore, the conventional lamp connector has a shorter service life. Further, the positive contact and the negative contact of the conventional lamp connector are disposed in a common accommodation space and are more likely to be affected by electromagnetic interference. Such a problem would affect the performance of products.

SUMMARY OF THE INVENTION

The objective of the present invention is to provide a novel lamp connector to overcome the drawbacks of the conventional lamp connector.

The technical scheme to realize the objective of the present invention is a lamp connector comprising a connector body and a contact, wherein the connector body has an accommodation space accommodating the contact, wherein the tail portion of the contact has a positioning hole, and wherein each connector body has a slot extending along the insertion direction of the contact on the two inner walls thereof, and wherein two edge fins of the contact are confined to the slot, and wherein the accommodation space has a elastic member, and wherein a barb protrudes from the elastic member and corresponds to the positioning hole, and wherein the front surface of the barb has a guide slope.

In one embodiment, the lamp connector of the present invention comprises a male plug and a female socket. The male plug includes a plug body and a plug contact. The plug body has an insert member and a first accommodation space accommodating the plug contact. The female socket includes a socket body and a socket contact. The socket body has an insert receiver corresponding to the insert member and a second accommodation space accommodating the socket contact, wherein the tail region of the plug contact has a first positioning hole; the first accommodation space has first slots extending along the insert direction of the plug contact on two sidewalls; the first accommodation space also has a first elastic member; the first elastic member further has a first barb protruding from the first elastic member and corresponding to the first positioning hole; the first barb further has a first guide slope on the front surface thereof; and wherein the tail region of the socket contact has a second positioning hole; the second accommodation space has a second slot extending along the insert direction of the socket contact on two sidewalls; the second accommodation space also has a second elastic member; the second elastic member further has a second barb protruding from the second elastic member and corresponding to the second positioning hole; the second barb further has a second guide slope on the front surface thereof; and wherein the front end of the socket contact has a recessed contact portion; the front end of the socket contact is bent upward and backward to form a first bent portion pressing against the inner upper wall of the socket body; and wherein the front end of the plug contact is bent downward to form a second bent portion; and wherein the plug body has a positive insert member and a negative insert member, which are separated from each other; correspondingly, the insert receiver of the socket body has a separation wall.

In the present invention, the slot, the elastic member and the barb in the plastic body cooperate with the positioning hole of the contact to complete the assemblage of the body and contacts. In assembling the body and the contact, the front end of the contact can easily overcome the elastic force of the elastic member and overpass the guide slope to go into the accommodation space with the edge fins of the contact longitudinally confined to the slot. While the positioning hole of the contact exactly coincides with the barb, the elastic force of the elastic member automatically spring the barb into the positioning hole. Thereby, the contact is transversely positioned in the plastic body. Therefore, the contact can be assembled to the plastic body faster, more conveniently and more firmly; the electric connection of the male plug and the female socket is more stable and more resistant to electromagnetic interference.

DETAILED DESCRIPTION OF THE INVENTION

Figure 7:
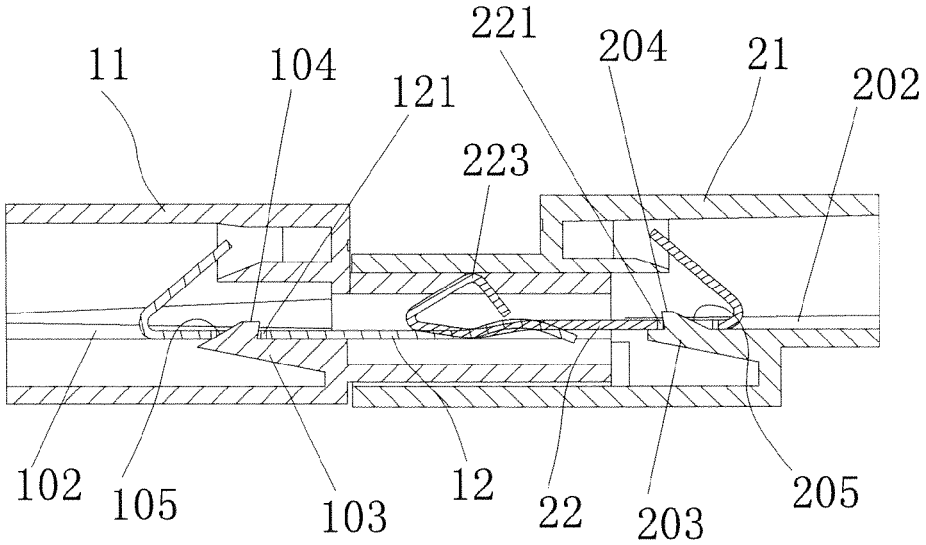
FIG. 7 is a sectional view schematically showing the engagement of a male plug and a female socket of a lamp connector according to one embodiment of the present invention.

Refer to FIG. 7 for a concise description of the present invention beforehand. The present invention proposes a lamp connector comprising a male plug and a female socket. The male plug includes a plug body and plug contacts. The female socket includes a socket body and socket contacts. The bodies respectively have accommodation spaces accommodating the contacts. The tail portion of the contact has a positioning hole. Each body has slots extending along the insertion direction of the contacts on the inner walls thereof. Two edge fins of the contact are confined to the slots. The accommodation space has elastic members. A barb protrudes from the elastic member and corresponds to the positioning hole. The front surface of the barb has a guide slope.

Below, embodiments are described in detail in cooperation with the attached drawings to demonstrate the technical contents of the present invention.

Figure 1:
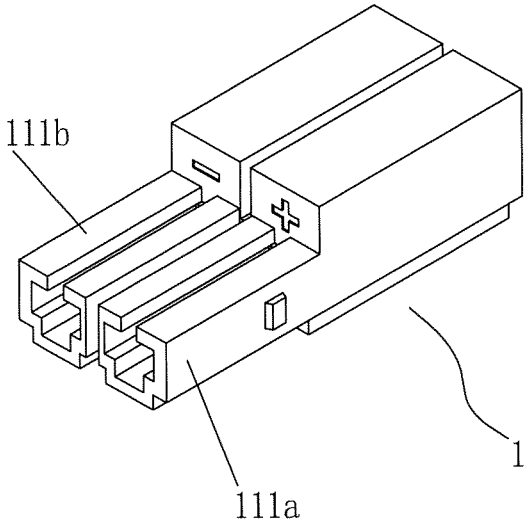
FIG. 1 is a perspective view schematically showing the appearance of a male plug of a lamp connector according to one embodiment of the present invention.
Figure 2:
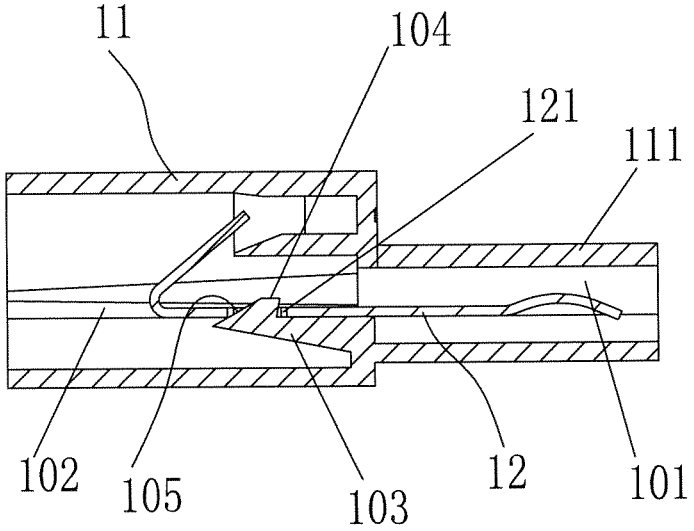
FIG. 2 is a sectional view schematically showing the structure of a male plug of a lamp connector according to one embodiment of the present invention.
Figure 3:
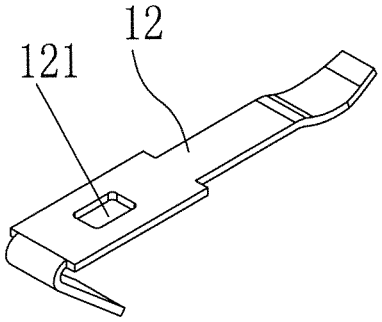
FIG. 3 is a perspective view schematically showing a plug contact of a male plug of a lamp connector according to one embodiment of the present invention.
Figure 4:
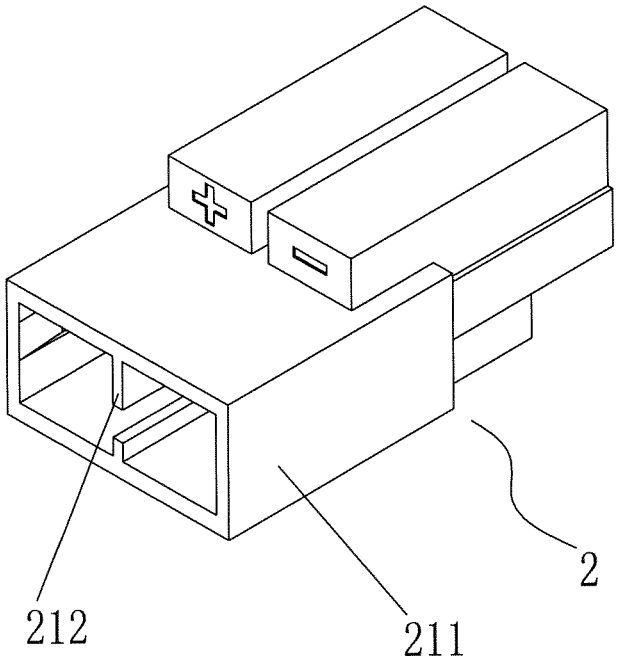
FIG. 4 is a perspective view schematically showing the appearance of a female socket of a lamp connector according to one embodiment of the present invention.
Figure 5:
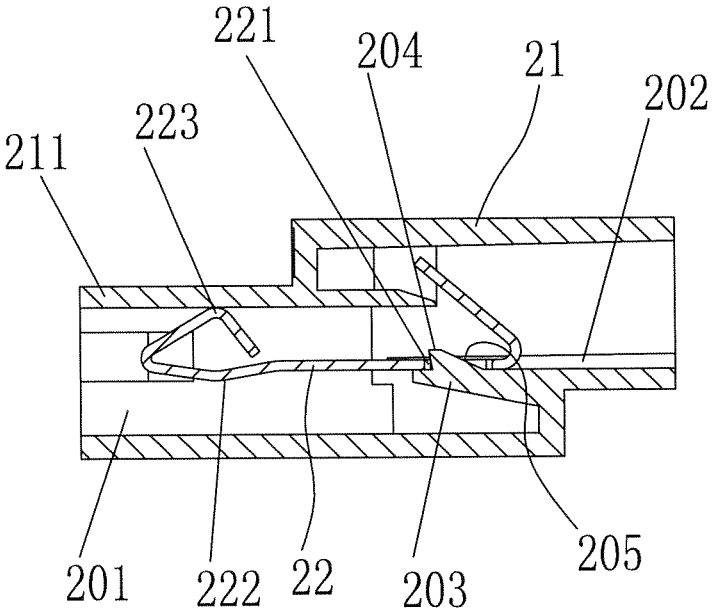
FIG. 5 is a sectional view schematically showing the structure of a female socket of a lamp connector according to one embodiment of the present invention.
Figure 6:
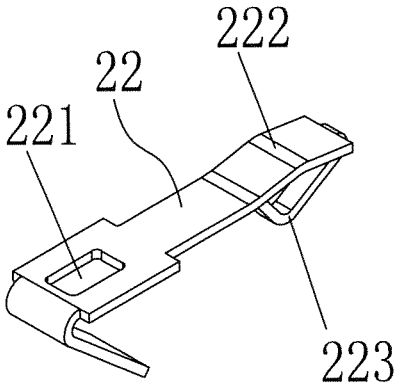
FIG. 6 is a perspective view schematically showing a socket contact of a female socket of a lamp connector according to one embodiment of the present invention.

The lamp connector of the present invention comprises a male plug 1 and a female socket 2. Refer to FIGS. 1-3. The male plug 1 includes a plug body 11 and plug contacts 12. The plug body 11 has an insert member 111 and a first accommodation space 101 accommodating the plug contacts 12. Refer to FIGS. 4-6. The female socket 2 includes a socket body 21 and socket contacts 22. The socket body 21 has an insert receiver 211 corresponding to the insert member 111 and a second accommodation space 201 accommodating the socket contacts 22.

The tail region of the plug contact 12 has a first positioning hole 121. The first accommodation space 101 has first slots 102 on two sidewalls along the insert direction of the plug contacts 12. Two edge fins of the plug contact 12 are confined to the first slots 102. The first accommodation space 101 also has first elastic members 103. The first elastic member 103 further has a first barb 104 corresponding to the first positioning hole 121. The first barb 104 further has a first guide slope 105 on the front surface thereof.

The tail region of the socket contact 22 has a second positioning hole 221. The second accommodation space 201 has second slots 202 on two sidewalls along the insert direction of the socket contact 22. Two edge fins of the socket contact 22 are confined to the second slots 202. The second accommodation space 201 also has second elastic members 203. The second elastic member 203 further has a second barb 204 corresponding to the second positioning hole 221. The second barb 204 further has a second guide slope 205 on the front surface thereof.

In the present invention, the slots, elastic members and barbs in the plastic bodies cooperate with the positioning holes of the contacts to complete the assemblage of the bodies and contacts. In assembling the body and the contact, the front end of the contact can easily overcome the elastic force of the elastic member and overpass the guide slope to go into the accommodation space with the edge fins of the contact longitudinally confined to the slots. While the positioning hole of the contact exactly coincides with the barb, the elastic force of the elastic member automatically spring the barb into the positioning hole. Thereby, the contact is transversely positioned in the plastic body.

The front end of the socket contact 22 has a recessed contact portion 222. The front end of the socket contact 22 is bent upward and the backward to form a first bent portion 223 pressing against the inner upper wall of the socket body 21. Refer to FIG. 7. While the male plug 1 is engaged with the female socket 2, the inner wall of the plug body 11 presses down the first bent portion 223 to make the contact portion 222 of the socket contact 22 tightly contact the plug contact 12 inside the plug body 11. Thereby is formed a firm electric connection.

Figure 8:
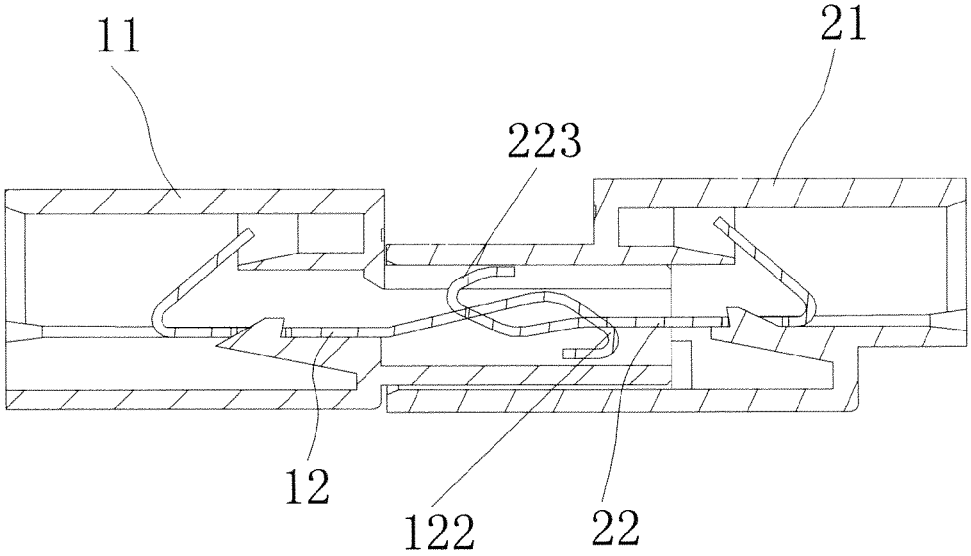
FIG. 8 is a sectional view schematically showing the engagement of a male plug and a female socket of a lamp connector according to another embodiment of the present invention.

Refer to FIG. 8. In another embodiment, the front end of the plug contact is bent downward to form a second bent portion 122 to make the plug contact 22 contact the socket contact 22 furthermore tightly and stably.

The plug body 11 has a positive insert member 111*a* and a negative insert member 111*b*, which are separated from each other. Correspondingly, the insert receiver 211 of the socket body 21 has a separation wall 212 whose thickness is equal to the spacing of the positive insert member 111*a* and the negative insert member 111*b*. Via the separation design, the connector can more effectively resist electromagnetic interference while the plug is engaged with socket.

In the lamp connector of the present invention, the contacts can be assembled to the plastic bodies faster, more conveniently and more firmly; the electric connection of the male plug and the female socket is more stable and more resistant to electromagnetic interference. Via appropriately modifying the sizes and shapes, the male plug and the female socket are compatible with the existing connectors of the same type. The user using the existing connector only needs to replace either the male plug or the female socket and thus spends less money and experiences less trouble in using the present invention.

What is claimed is:

1. A lamp connector comprising a contact and a connector body having an accommodation space accommodating said contact, and characterized in that a tail portion of said contact has a positioning hole, and that said connector body has a slot extending along an insertion direction of said contact on two inner walls thereof respectively, and that two edge fins of said contact are confined to said slot, and that said accommodation space has an elastic member, and that a barb protrudes from said elastic member and corresponds to said positioning hole, and that a front surface of said barb has a guide slope.

2. A lamp connector comprising a male plug and a female socket, wherein said male plug includes a plug body and a plug contact, and wherein said plug body has an insert member and a first accommodation space accommodating said plug contact, and wherein said female socket includes a socket body and a socket contact, and wherein said socket body has an insert receiver corresponding to said insert member and a second accommodation space accommodating said socket contact, and wherein said lamp connector is characterized in that a tail region of said plug contact has a first positioning hole, and that said first accommodation space has a first slot on two sidewalls along an insert direction of said plug contact, and that said first accommodation space also has a first elastic member, and that said first elastic member further has a first barb corresponding to said first positioning hole, and that said first barb further has a first guide slope on a front surface thereof, and that a tail region of said socket contact has a second positioning hole, and that said second accommodation space has a second slot on two sidewalls along an insert direction of said socket contact, and that said second accommodation space also has a second elastic member, and that said second elastic member further has a second barb corresponding to said second positioning hole, and that said second barb further has a second guide slope on a front surface thereof.

3. The lamp connector according to claim 2 characterized in that a front end of said socket contact has a recessed contact portion, and that said front end of said socket contact is bent upward and backward to form a first bent portion pressing against an inner upper wall of said socket body.

4. The lamp connector according to claim 2 characterized in that a front end of said plug contact is bent downward to form a second bent portion.

5. The lamp connector according to claim 2 characterized in that said plug body has a positive insert member and a negative insert member, which are separated from each other, and that said insert receiver of said socket body has a separation wall corresponding to said positive insert member and said negative insert member.

* * * * *